US006144172A

United States Patent [19]

Sun

[11] Patent Number: 6,144,172

[45] Date of Patent: Nov. 7, 2000

[54] METHOD AND DRIVING CIRCUIT FOR HID LAMP ELECTRONIC BALLAST

[75] Inventor: Yiyoung Sun, Beverly, Mass.

[73] Assignee: Matsushita Electric Works R&D Laboratory, Inc., Woburn, Mass.

[21] Appl. No.: 09/311,568

[22] Filed: May 14, 1999

[51] Int. Cl.[7] ..... G05F 1/00

[52] U.S. Cl. ..... 315/291; 315/307; 315/209 R; 315/224; 315/DIG. 5

[58] Field of Search ..... 315/224, 291, 315/307, 209 R, 244, 247, DIG. 5, DIG. 7; 341/50, 131, 143

[56] References Cited

U.S. PATENT DOCUMENTS

| | | | |
|---|---|---|---|
| 4,373,146 | 2/1983 | Bonazoli et al. | 315/209 R |
| 4,705,991 | 11/1987 | Ganser et al. | 315/209 R |
| 4,904,907 | 2/1990 | Allison et al. | 315/307 |
| 5,569,984 | 10/1996 | Holtslag | 315/307 |
| 5,932,976 | 8/1999 | Maheshwari et al. | 315/291 |
| 5,986,901 | 11/1999 | Weng | 363/44 |
| 5,995,398 | 11/1999 | Yamauchi et al. | 363/98 |
| 6,020,691 | 2/2000 | Sun et al. | 315/307 |

OTHER PUBLICATIONS

"White–Noise Modulation of High–Frequency High–Intensity Discharge Lamp Ballasts", Laszlo Laskai, IEEE Industrial Applications Society Conference, 1994 (IEEE Pub. 0–7803–1993–1/1994).

"High–Frequency Ballasting Techniques for High–Intensity Discharge Lamps", Laszlo Laskai, Ph.D. Dissertation, Texas A&M University, Dec., 1994.

"How to Build and Test a 5 stage PN Generator", Spread Spectrum Scene, World Wide Web url: http://www.sss–mag-.com/png0.html, printed on Mar. 30, 1999.

*Primary Examiner*—Haissa Philogene

*Attorney, Agent, or Firm*—Greenblum & Bernstein, P.L.C.

[57] ABSTRACT

A circuit arrangement and method thereof for operating high intensity discharge (HID) lamps with a lower frequency rectangular current waveform, in which the frequency of the higher frequency ripple superimposed on the lower frequency rectangular current is modulated by a pseudo-random noise signal. The pseudo-random noise may be generated by a feedback shift register. The feedback shift register may incorporate run length interrupt logic to address PWM frequency stagnation by reducing the longest run length or lengths of the feedback shift register. The feedback shift register may also or alternatively include an RC low pass analog filter to address PWM frequency stagnation. The center frequency and frequency band of the pseudo-randomly generated noise may be adjustable.

24 Claims, 9 Drawing Sheets

METHOD AND DRIVING CIRCUIT FOR HID LAMP ELECTRONIC BALLAST

BACKGROUND OF THE INVENTION

1. Field of the Invention

The invention relates to a control method and to circuit arrangements to operate a high intensity discharge lamp with a lower frequency rectangular current waveform generated electronically by a higher frequency inverter.

2. Description of Background Information

In electronic high intensity discharge lamp ballasts, there are two distinctly different methods to drive the lamp. The first method is to drive the lamp with high frequency sinusoidal current, and the second is to drive the lamp with low frequency rectangular current. Many efforts have been made to stabilize the HID lamp operation with both the high frequency sinusoidal and the low frequency rectangular driving method.

U.S. Pat. No. 4,373,146 to Robert R. Bonazoli et al., issued Feb. 8, 1983, discloses a method of operating HID lamps in which frequency modulation of a carrier waveform in the kilohertz range is used to provide a variable high frequency AC output. The variable high frequency AC output is then applied across the HID lamp to operate the lamp in a manner that minimizes or avoids acoustic resonance. As further discussed in the above-noted patent, the arc instability caused by acoustic resonance depends upon both the shape of the carrier waveform and the shape of the modulating signal. The patent discloses that a rectangular carrier waveform is much more desirable than a sinusoidal carrier for arc stability, and that a saw tooth modulating signal of between 1 ms to 10 ms per cycle with a retrace time of less than 1 $\mu$s is better than a triangular modulating signal. One drawback of the technique disclosed in this patent is that the lamp is still driven by a high frequency current in the kilohertz range. Due to the complexity of the acoustic resonance, arc instability may occur with lamps made by different manufacturers, different batches of the same type of lamp, and lamps at different points in their service life (new, seasoned, and end of life). It is very difficult, if not impossible, to evaluate all the available lamps for acoustic resonance, and moreover, to evaluate the available lamps for acoustic resonance at different times in their service life. Another drawback of this disclosure of this patent, which is not mentioned but is implied by the disclosure, is that the acoustic resonant frequency of a lamp should be avoided at near the lowest operating frequency or near the highest operating frequency. If the acoustic resonant frequency of a lamp is either near the lowest operating frequency or near the highest operating frequency, arc instability may occur. This phenomenon can be explained using frequency domain analysis. In the frequency domain, it can be found that the magnitude of harmonics is highest on two edges of the frequency spectrum, which corresponds to the frequencies near the lowest or the highest frequency in the time domain.

U.S. Pat. No. 5,569,984 to Antonius H. Holtslag, issued Oct. 29, 1996, describes another method to drive a HID lamp with high frequency sinusoidal current. The complicated control circuitry disclosed in this patent constantly detects the conductivity of the HID lamp and the operating frequency. Selection of the operating frequency to avoid acoustic resonance is based on the evaluation of the deviation of the lamp conductivity. After the ballast finds the lowest deviation of the lamp conductivity, the operating frequency is then temporarily fixed until the deviation exceeds the predefined limits. The intelligence of the disclosed control scheme lends itself for driving HID lamps with high frequency current under different conditions, such as aging of the lamp, different manufacturers, different types of HID lamps, and different batches of the same type, over a certain operating frequency range. A significant drawback of this disclosure is the complexity of the control circuitry. Another drawback of the disclosure of the above-noted patent is that the algorithm for differentiating true acoustic resonance from any other arc instability (such as arc jumps, flare ups, and arc movement caused by any mechanical movement of the lamp) may actually need to be more complicated than the double scan algorithm disclosed.

A paper titled "White-Noise Modulation of High-Frequency High-Intensity Discharge Lamp Ballasts" by Laszlo Laskai, in IEEE Industrial Applications Society Conference, 1994 (IEEE Pub. 0-7803-1993-1/94), and a Ph.D. dissertation (Texas A&M University, College Park, Tex.) entitled "High-frequency ballasting techniques for high-intensity discharge lamps" by the same author discuss high frequency sinusoidal current operation with white-noise modulation to avoid arc instability. It achieved better results than the frequency modulation (FM) method. However, the white-noise method has significant drawbacks as well, in that an operating frequency range having a portion free from acoustic resonance must be found. Otherwise, the arc will not be stable, primarily because of acoustic resonance.

Driving high intensity discharge lamps via low frequency rectangular current driving, in general, is a better method than the high frequency (sinusoidal or rectangular) waveform. The industry, by virtue of experience, accepts that to avoid arc instability due to acoustic resonance, the ratio of a superimposed high frequency switching ripple current to the low frequency driving current has to be sufficiently low, usually below 10%.

U.S. Pat. No. 4,904,907 to Joseph M. Allison et al., issued Feb. 27, 1990, discloses a modified buck topology in which an LC parallel resonant network is inserted into the buck inductor. The inserted LC parallel resonant network has its resonant frequency at the buck operating frequency. The ripple current of the fundamental switching frequency of the buck power regulator is attenuated significantly by the resonant network, and the high frequency ripple current through the lamp is much less than the low frequency rectangular lamp current. Arc instability due to acoustic resonance will not occur. However, this method has its own drawbacks, in that the attenuation factor is highly sensitive to the frequency variation of the buck converter. A small decrease or increase in switching frequency will adversely affect the high frequency ripple current to low frequency lamp current ratio. If the ripple exceeds the threshold of acoustic resonance, arc instability may occur.

In low frequency electronic high intensity discharge lamp ballasts disclosed in the prior art, the higher frequency ripple superimposed on the lower frequency rectangular current has to be attenuated below a certain threshold (usually below 10%) to avoid acoustic resonance. One method to attenuate higher frequency ripple is to have large capacitance and small inductance in the LC low-pass output filter network. The inductor is in discontinuous current mode and the switching elements are in zero current switching, and the efficiency of the switching elements is therefore high. However, the physical size and the cost of the capacitor increases. Another method to attenuate higher frequency ripple is to increase the inductance and the capacitance of the LC low-pass filter. The inductor is now in continuous current mode and the switching elements are in hard switching mode. However, for this method, the efficiency is low due to increased switching losses, and if resonant ignition is used, the problem is further complicated. The discontinuous current mode with large capacitance cannot be used for resonant ignition due to extremely high circulating current. To use resonant ignition while maintaining low ripple, the capacitance needs to be small and the inductance needs to be large.

SUMMARY OF THE INVENTION

The present invention overcomes at least the drawbacks noted above, that is, (i) the poor operation of a high intensity discharge lamp when driven by high frequency current, (ii) complicated feedback control schemes to minimize acoustic resonance due to high frequency operation, (iii) the need for selecting a frequency band within which the arc is stable without frequency modulation, and (iv) the demand for very low high frequency ripple for low frequency rectangular current operation.

Accordingly, one object of the invention is to simplify the control scheme for operating a high intensity discharge lamp by replacing high frequency current operation with rectangular low frequency operation and superimposed high frequency ripple.

Another object of the invention is, for low frequency rectangular lamp operation, to relax the conventional requirement (less than 10%) of the amount of high frequency ripple superimposed on the low frequency rectangular current and yet to nonetheless avoid acoustic resonance.

Another object of the invention is to modulate the high frequency ripple superimposed on the low frequency rectangular current so that the higher frequency ripple to lamp current ratio in time domain of 20% can be tolerated without arc instability.

Yet another object of the invention is that the frequency band of the higher frequency ripple should include any lamp acoustic resonance regions without causing arc instability due to acoustic resonance.

According to a first aspect of the present invention, a method of driving a high intensity discharge lamp includes delivering power to the high intensity discharge lamp during normal operation after starting using a lower frequency rectangular wave current, modulating a frequency of a higher frequency ripple using a pseudo-random signal, the pseudo-random modulation preventing arc instability due to acoustic resonance, and superimposing the pseudo-randomly modulated higher frequency ripple on the lower frequency rectangular wave current delivered to the high intensity discharge lamp.

In this manner, the lower frequency rectangular current delivers power to the lamp in a manner that is free from arc instability due to acoustic resonance. For low frequency rectangular lamp operation, the conventional requirement of very low high frequency ripple superimposed on the low frequency rectangular current is relaxed, yet the pseudo-random modulation prevents arc instability due to acoustic resonance. The high frequency ripple superimposed on the low frequency rectangular current may be 20% or higher, and arc stability remains very good. The frequency band of the higher frequency ripple may include the lamp acoustic resonance regions, and nevertheless avoids arc instability due to acoustic resonance. Further, the lower frequency rectangular current is optionally no greater than approximately 1 KHz.

Optionally, the method may further include igniting the high intensity discharge lamp with an ignition voltage, the ignition voltage being biased by a lower frequency rectangular voltage. Optionally, the ignition voltage has a frequency no less than approximately 16 KHz, this ignition voltage being generated by a resonant circuit. In this case, the ignition voltage preferably has a frequency no less than approximately 20 KHz.

The method may further include generating, by a half bridge inverter, both the higher frequency ripples and the lower frequency rectangular current, and regulating, also by the half bridge inverter, lamp power and lamp output. Alternatively, the method may further include generating, by a full bridge inverter, both the higher frequency ripples and the lower frequency rectangular current, and regulating, also by the full bridge inverter, lamp power and lamp output.

In a first variation of the pseudo-random noise generation, the pseudo-random signal is optionally generated with a feedback shift register.

In a second variation of the pseudo-random noise generation of this aspect of the invention, when the feedback shift register is used to generate the pseudo-random signal, the method may include filtering a digital output of the feedback shift register by a low pass RC filter to modulate the higher frequency ripples.

In this manner, the digital signal is filtered so that the pseudo-random signal is more like an exponential ramp than a rectangular wave, which addresses PWM frequency stagnation. The analog RC low pass filter is also simple in construction.

In the case of the first variation of pseudo-random noise generation, the method may further include a third variation of interrupting an output sequence of the feedback shift register, and modulating a number of consecutive runs in states of the feedback shift register. The modulating may include reducing a length of a longest run length among the states of the feedback shift register.

In this manner, frequency stagnation caused by long run lengths is addressed, and the extra digital logic circuit to create the state sequence modification can be integrated into the basic feedback shift register.

According another aspect of the present invention, a discharge lamp driving circuit for driving a high intensity discharge lamp includes DC voltage input connections for powering the discharge lamp driving circuit, and lamp-driving connections between which the high intensity discharge lamp is connectible. Bridge circuitry is connected to the DC voltage input connections, the bridge circuit including high/low frequency driver control circuitry connected to drive switching elements of the bridge circuitry. The high/low frequency driver control circuitry ignites a lamp connected between the lamp driving connections by a higher frequency voltage, biased by a lower frequency rectangular voltage during starting. An LC tank circuit is connected to the lamp driving connections and to the switching elements of the bridge circuitry, and a voltage controlled pulse width modulation (PWM) ramp generator is connected to the high/low frequency driver control circuitry to modulate the switching duty cycle of the switching elements using a PWM signal. A pseudo-random noise generator is connected to the voltage controlled PWM ramp generator to modulate the frequency of the PWM signal by pseudo-random noise.

The switching elements may be in half bridge configuration, or may be in full bridge configuration.

As noted above, in this manner, the lower frequency rectangular current delivers power to the lamp in a manner that is free from arc instability due to acoustic resonance. For low frequency rectangular lamp operation, the conventional requirement of very low high frequency ripple superimposed on the low frequency rectangular current is relaxed, yet the pseudo-random modulation prevents arc instability due to acoustic resonance. The high frequency ripple superimposed on the low frequency rectangular current may be 20% or higher, and arc stability remains very good. The frequency band of the higher frequency ripple may include the lamp acoustic resonance regions, and nevertheless avoids arc instability due to acoustic resonance.

Optionally, the ignition voltage has a frequency no less than approximately 16 KHz, this ignition voltage being generated by a resonant circuit. In this case, the ignition voltage preferably has a frequency no less than approximately 20 KHz. Further, the lower frequency rectangular current is optionally no greater than approximately 1 KHz.

Optionally, in a first variation of the pseudo-random noise generator, the digital pseudo-random noise generator may be embodied by a generator including a feedback shift register having at least a 4-bit length. In this case, the digital pseudo-random noise generator preferably includes a feedback shift register having at least a 16-bit length.

In a second variation of the pseudo-random noise generator according to this aspect of the present invention, the pseudo-random noise generator may include an RC low pass filter having a time constant substantially equal to or greater than a clock period of the feedback shift register, coupled between an output of the feedback shift register and an input of the voltage controlled PWM ramp generator. The RC low pass filter further modulates the PWM ramp.

In this manner, as previously noted, the digital signal is filtered so that the pseudo-random signal is more like an exponential ramp than a rectangular wave, which addresses PWM frequency stagnation. The analog RC low pass filter is also simple in construction.

Optionally, the pseudo-random noise generator may include a frequency band adjusting circuit connected between the pseudo-random noise generator and the bridge circuit, for adjusting the frequency band of higher frequency ripple. Further optionally, the pseudo-random noise generator may include a center frequency adjusting circuit connected between the pseudo-random noise generator and the bridge circuit for adjusting the center frequency of the higher frequency ripple.

In a third variation of the pseudo-random noise generator of this aspect of the invention, the digital pseudo-random noise generator including a feedback shift register having at least a 4-bit length, and the feedback shift register including a run-length interrupt logic circuit that modulates a number of consecutive runs in states of the feedback shift register. In this case, the run-length interrupt logic circuit may reduce a length of a longest run length among the states of the feedback shift register.

In this manner, as previously noted, PWM frequency stagnation caused by long run lengths is addressed, and the extra digital logic circuit to create the state sequence modification can be integrated into the basic feedback shift register.

BRIEF DESCRIPTION OF THE DRAWINGS.

The present invention is further explained in the description which follows with reference to the drawings, illustrating, by way of non-limiting examples, various embodiments of the invention, with like reference numerals representing similar parts throughout the several views, and wherein.

DETAILED DESCRIPTION OF THE PREFERRED EMBODIMENTS

Figure 1:
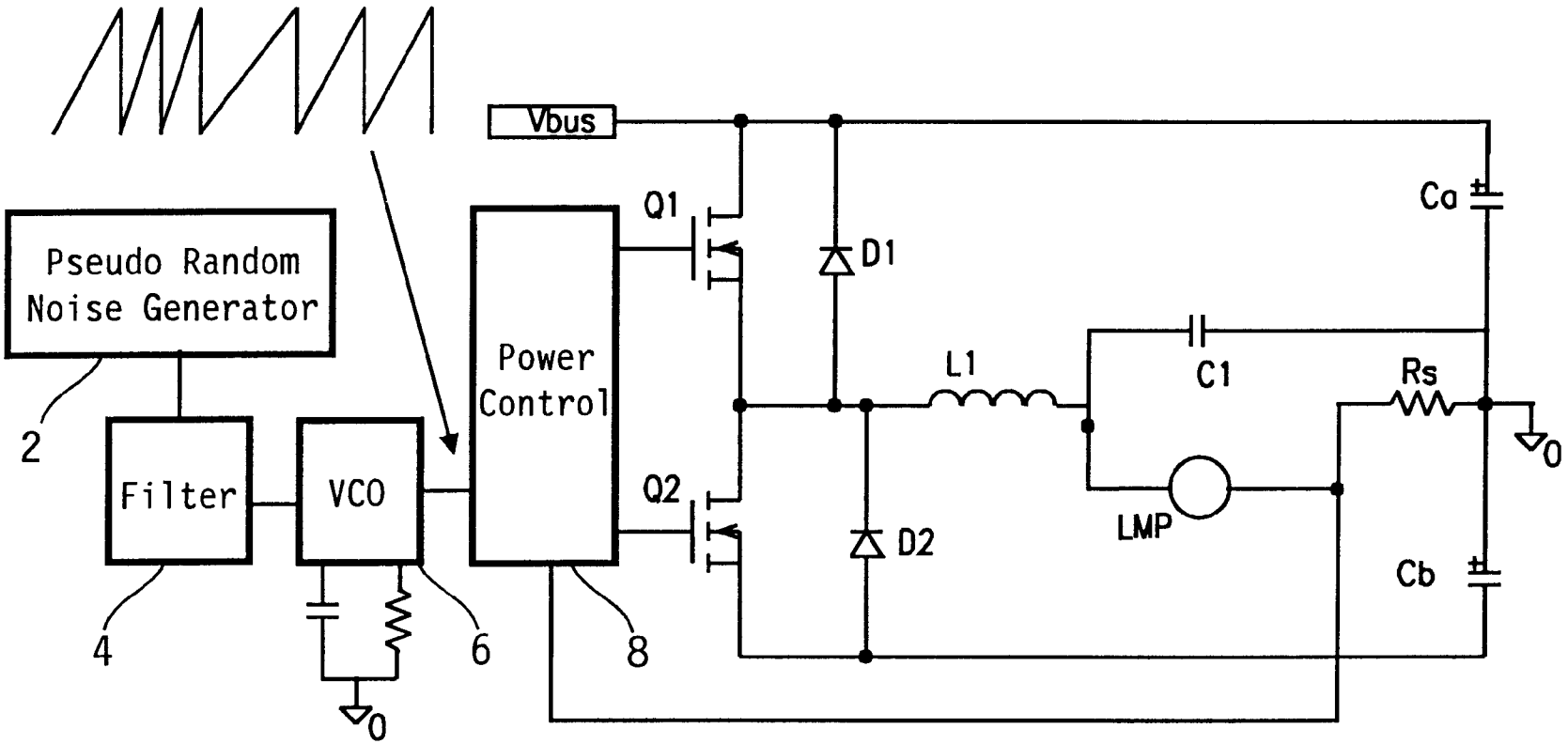
FIG. 1 shows a block diagram of a first embodiment of the present invention, in half bridge configuration.

It should be noted that hereinafter, "inductor" and "inductance" are used interchangeably, as are "capacitor" and "capacitance." Reference characters for inductors refer to either the inductor itself or its inductance value, and reference characters for capacitors refer to the capacitor itself or its capacitance value.

Figure 2:
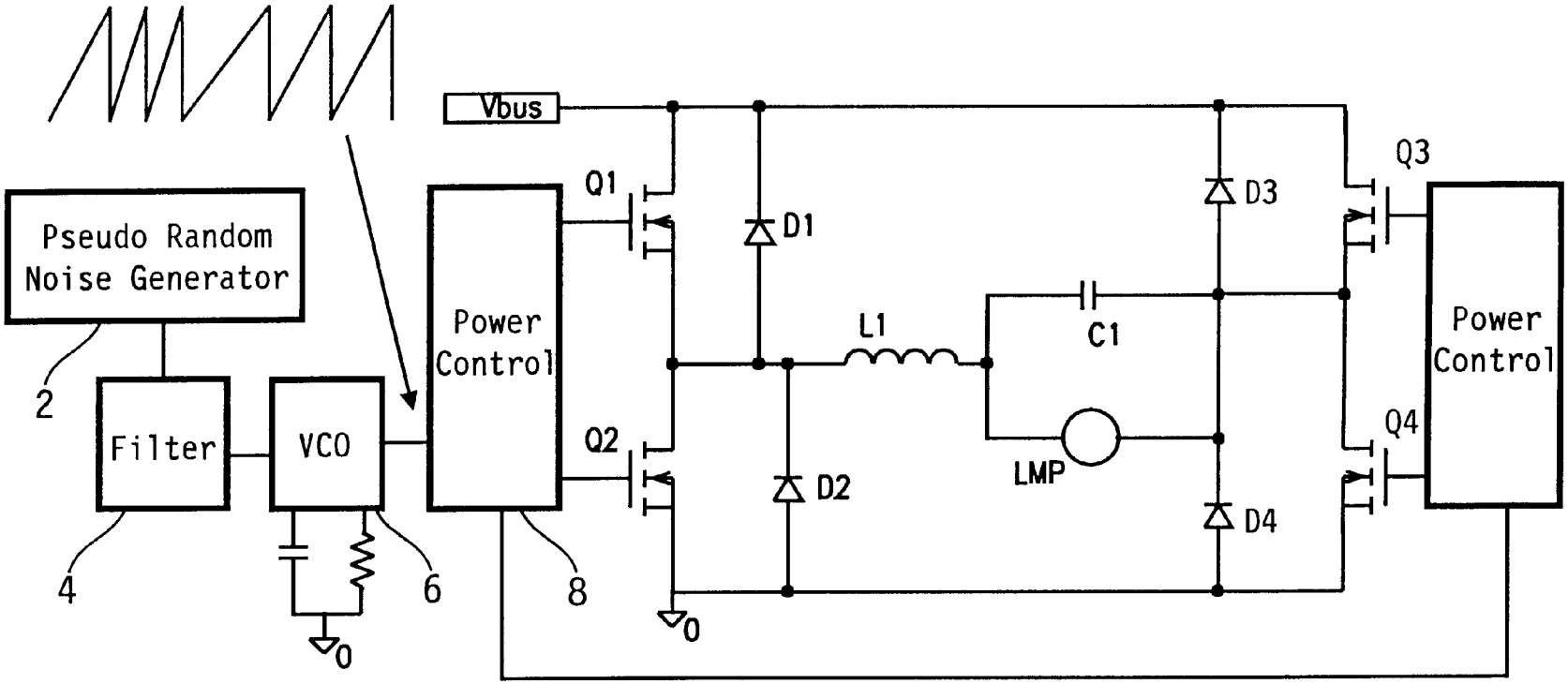
FIG. 2 shows a block diagram of a second embodiment of the present invention, in full bridge configuration.

FIG. 1 shows a block diagram of a first embodiment of the present invention (in half bridge configuration), and FIG. 2 shows a block diagram of a second embodiment of the present invention (in full bridge configuration). The driving circuits of FIGS. 1 and 2 operate a high intensity discharge lamp with a lower frequency rectangular wave current having pseudo-randomly modulated higher frequency ripples superimposed thereon.

As shown in FIG. 1, the discharge lamp driving circuit includes DC voltage input connections in the form of a DC voltage source Vbus. The DC voltage source Vbus comes either from a power factor correction circuit or directly from a rectified and filtered AC line without power factor correction.

An inductance L1 and a capacitance C1 constitute an LC tank circuit (including a resonant circuit) connected to a first lamp driving connection and a second lamp driving connection of a high intensity discharge lamp LMP. The inductance L1 and the capacitance C1 are connected to the first lamp driving connection (i.e., at the junction of LMP, L1, and C1). The inductance L1 is connected to a first arm of bridge circuitry (described below), while the capacitance C1 is connected to the second arm of the bridge circuitry. The second lamp driving connection is also connected to the second arm of the bridge circuitry via a detecting resistor Rs. Rs is optionally approximately 0.1 to 0.4 Ω. The bridge circuitry is connected to the DC voltage input connections (Vbus) and to the tank circuit.

Capacitors Ca and Cb are energy storage elements. Capacitance of the energy storage elements (capacitors) Ca and Cb is selected to be quite large (e.g., about 100 $\mu$F electrolytic capacitor for 70 W output power) so that the voltage across Ca or Cb is almost constant, with a small amount of low frequency triangular ripple superimposed thereon. Ca and Cb are optionally equal, and optionally within the range of approximately 47 $\mu$F to 220 $\mu$F.

Diodes D1 and/or D2 carry freewheeling current after switching element Q2 or Q1 turns off, respectively. That is, when switching element Q2 turns off, diode D1 carries freewheeling current until switching element Q2 turns on again, and when switching element Q1 turns off, diode D2 carries freewheeling current until Q1 turns on again. It should be noted that high speed MOSFETs may include integrated high-speed diodes that carry the freewheeling current, and if switching elements Q1 and Q2 are of this type, then diodes D1 and D2 would not be required in the circuit.

The bridge circuitry includes a power control 8 including high/low frequency (dual functional) driver control circuitry connected to drive the switching elements Q1 and Q2. The first and second switching elements Q1 and Q2 (in the embodiment NMOS MOSFETs with substrate shorted to source) form a half bridge circuit. In a second embodiment (shown in FIG. 2, and discussed below), energy storage elements Ca and Cb can be replaced by a pair of active switches (such as MOSFETs), in which case a fill bridge scheme is formed in conjunction with the first switching element Q1 and the second switching element Q2. Accordingly, the switching elements may be either in half bridge configuration or in full bridge configuration.

During normal operation, the first and second switching elements Q1 and Q2 are high frequency switches that turn on and off alternatively as driven by a power control 8, which uses a voltage controlled oscillator VCO 6 to generate a saw-tooth waveform as an input for modulating the switching. The VCO 6, in turn, uses a digital pseudo-random signal from a pseudo-random noise generator 2, which may be filtered by a filter 4, as an input for modulating the saw-tooth waveform.

FIG. 2 shows a second embodiment of the invention, substantially corresponding to the circuit of FIG. 1, but in full bridge configuration. In the alternative topological arrangements shown in FIG. 2, energy storage elements Ca and Cb can be replaced by a pair of active switches Q3 and Q4, forming a full bridge scheme in conjunction with the first switching element Q1 and the second switching element Q2. Accordingly, in the second embodiment of FIG. 2, the switching elements Q1, Q2, Q3, and Q4 are in full bridge configuration. In the full bridge configuration shown in FIG. 2, the lamp current is sensed through the lamp LMP directly, or through the inductor L1 indirectly. It should be noted that switching elements Q1, Q2, Q3, Q4 and corresponding diodes D1, D2, D3, and D4 may be replaced with high speed MOSFETS incorporating their own built-in high speed diodes that carry freewheeling current as previously discussed.

Each of the driving circuits of FIGS. 1 and 2 include the DC voltage input connections Vbus, the lamp-driving connections across which the LMP is connected, the LC tank circuit L1-C1 connected to the lamp driving connections, and bridge circuitry connected to the DC voltage input connections Vbus and to the LC tank circuit L1-C1. The lamp, during starting, is ignited by sufficient ignition voltage at a higher frequency generated by the LC tank circuit L1, C1, biased by the lower frequency alternating rectangular voltage.

The bridge circuitry includes power control 8 that implements high/low frequency dual functional driver control circuitry, and is connected to drive the switching elements Q1 and Q2 (and/or switching elements Q3 and Q4 of the second embodiment). The ignition voltage preferably is of a frequency greater than or equal to 16 KHz, and more preferably, of a frequency greater than or equal to 20 KHz, generated by a resonant circuit (e.g., LC tank circuit L1, C1).

The bridge circuits of FIGS. 1 and 2 deliver low frequency rectangular current to the lamp LMP through the LC tank circuit (L1, C1) , which may also be considered a low pass filter network. For continuous current mode and resonant ignition, the inductor L1 is several millihenries (e.g., 0.5 to 20 mH) and the capacitor C1 is several nanofarads (e.g., 0.5 to 20 nF). For other arrangements, the inductor L1 and the capacitor C1 may vary depending upon actual design and application. The lamp power is regulated by the power control 8 circuit using pulse width modulation (PWM).

A saw tooth signal, generated by the VCO 6, is used as a reference saw tooth signal for PWM, and the frequency of the reference saw tooth signal is modulated by pseudo-random noise from the pseudo-random noise generator 2. That is, the VCO 6 may be considered a voltage controlled pulse width modulation (PWM) ramp generator for modulating the duty cycle of the power inverter (power control 1 and bridge circuitry).

In summary, the high intensity discharge lamp LMP is operated with a lower frequency rectangular wave current having the pseudo-random noise modulated higher frequency ripples superimposed thereon. The lower frequency rectangular current delivers power to the lamp LMP in a manner that is free from arc instability due to acoustic resonance. During starting, the high intensity discharge lamp LMP is ignited with sufficient ignition voltage, biased by a lower frequency rectangular voltage. During normal operation after starting, the frequency of the higher frequency ripple superimposed on the lower frequency rectangular wave is modulated using a pseudo-random signal. The ignition voltage has frequencies over 16 KHz, and preferably over 20 KHz, generated by the tank or resonant circuit L1, C1. The lower frequency rectangular wave current has a frequency below 1 KHz. Both the higher frequency ripples and the lower frequency rectangular current are generated by a half bridge or a full bridge inverter that regulates the lamp power and lamp current.

One kind of pseudo-random signal generator is a feedback shift register, although other kinds of pseudo-random signal generator or random signal generator may be used in the first and second embodiments to modulate the higher frequency superimposed ripple. A shift register of length m bits is clocked at a fixed rate, $f_{clock}$. An XOR (or alternatively, an XNOR) gate generates the serial input signal from the XOR inputs, which are tapped from an $n^{th}$ bit of the shift register and the last bit of the shift register (the $m^{th}$ bit). The feedback shift register goes through a set of states, and eventually repeats itself after k clock cycles. That is, the period, $T_{shift}$, of this register is k times the inverse of the clock frequency, $f_{clock}$.

Figure 3:
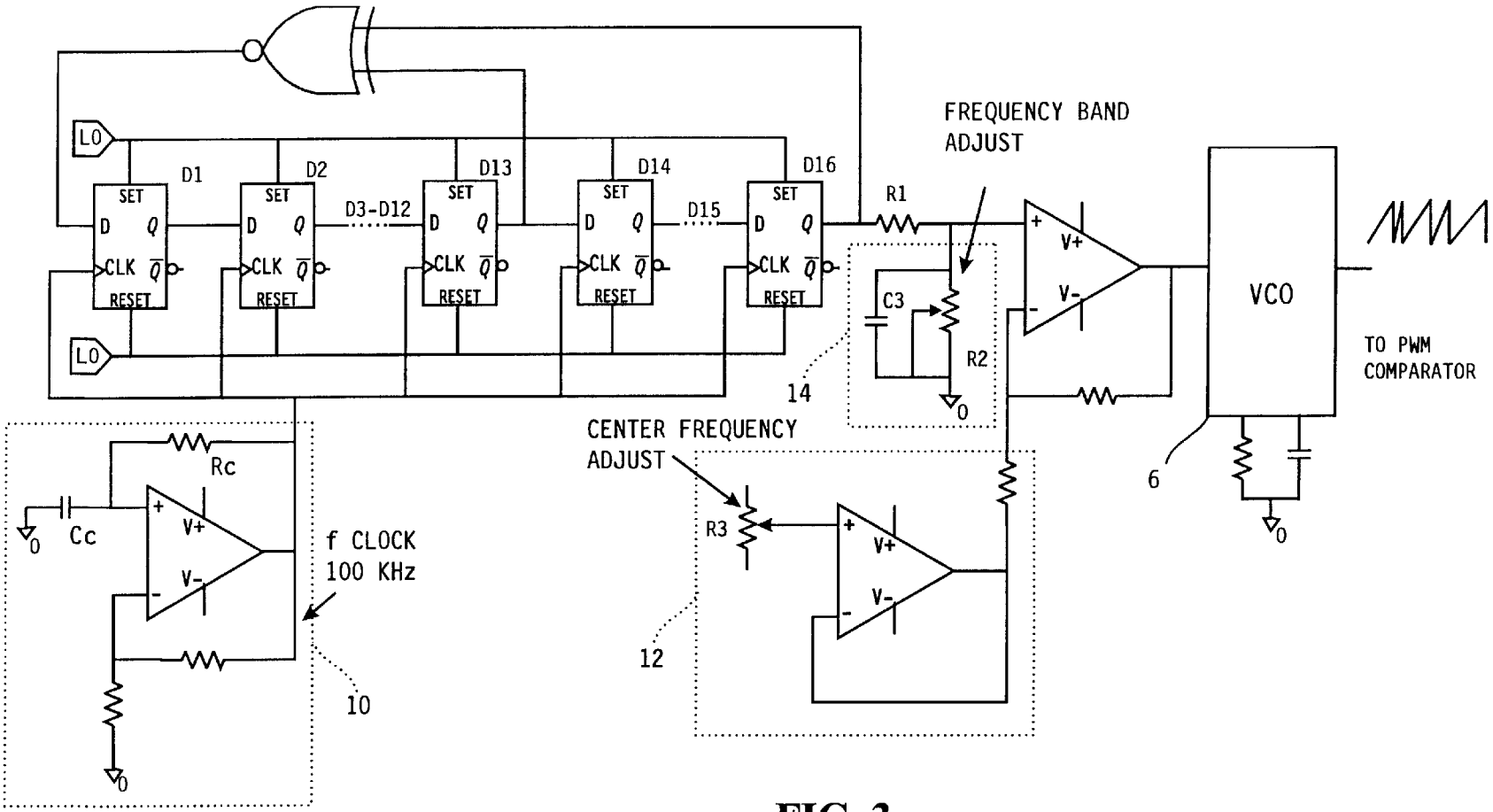
FIG. 3 shows a schematic of a 16-bit pseudo-random noise generator and related circuit to control the PWM (pulse width modulation) frequency.

FIG. 3 shows a schematic of a 16-bit pseudo-random noise generator and related circuit to control the PWM frequency (e.g., a 16-bit XNOR feedback shift register) of a first variation of the first and second embodiments. The generator of FIG. 3 includes 16 D-type flip-flops D1–D16 connected as a shift register. Although not all of the flip-flops are shown in FIG. 3, all of the flip-flops D1–D16 are connected at CLK to a clock circuit 10, from Q to D in line with each other, and to reset/set logic LO. The XNOR gate generates the serial input signal into the D input of the first flip-flop D1 from the XNOR inputs, tapped from a $13^{th}$ bit of the shift register and the last ($16^{th}$) bit of the shift register. Other bits may be used for the XNOR tap other than the $13^{th}$ bit, but the $16^{th}$ bit is always used as the other tap. The clock circuit 10 is set to the appropriate frequency (in FIG. 3, for example, 100 KHz) by selection of the RC values of Rc and Cc. The pseudo-random noise generator of FIG. 3 permits the adjustment of the frequency band in the time domain and the adjustment of the center frequency of the saw tooth. For example, the saw tooth frequency band in the time domain is adjusted by changing the voltage swing of the pseudo-random noise generator output. In the pseudo-random noise generator of FIG. 3, an adjustable resistor R2 of a frequency band adjust circuit 14 sets the range of the voltage swing. An adjustable resistor R3 in a center frequency adjusting circuit 12 sets the bias level, which determines the saw tooth center frequency.

An "all one" state is not permitted in the XNOR feedback shift register of FIG. 3 because the feedback shift register will become "stuck" if such occurs—that is, the feedback will continue to generate all ones. It should be noted that, in order to restart $T_{shift}$, a reset logic circuit is preferably incorporated in the generator of FIG. 3, connected individually to the SETs and/or RESETs of each of the flip-flops (as shown by LO in FIG. 3). Such a reset logic circuit may, for example, link the outputs Q of all the participating flip-flops D1 . . . Dn, waiting for the "stuck" state, and when the "stuck" state is reached, sends a reset or set signal to all the flip-flops. For example, an AND gate between all of the Q outputs, outputting to RESET of all the flip-flops, effectively resets all the flip-flops to the "all-zeros" state when the "all-ones" state occurs.

The first variation of the pseudo-random noise generator may be applied to either of the first or second embodiments of the present invention to modulate the power inverter's higher frequency ripples. As previously discussed, the output of the last flip-flop D16 is then input to the VCO 6 for modulating the sawtooth waveform generated therein.

Figure 4:
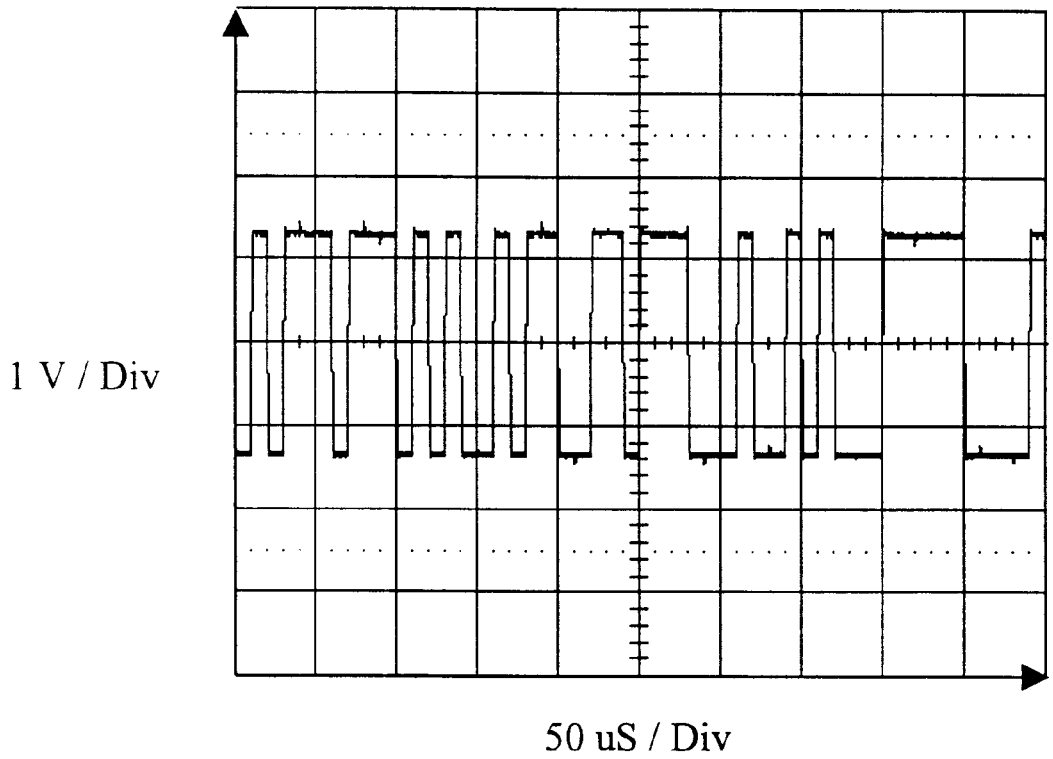
FIG. 4 shows a digital output signal of the pseudo-random noise generator, as a first variation of the pseudo-random noise generator.

FIG. 4 shows a digital pseudo-random noise output generated by the first variation of a pseudo-random noise generator (FIG. 3, but without the participation of an RC analog filter discussed below), scaled down from ±5 V. This 16-bit (unfiltered) digital pseudo-random signal is used as the input of the voltage controlled oscillator VCO 6 of the first and second embodiments of FIGS. 1 and 2.

Figure 5A:
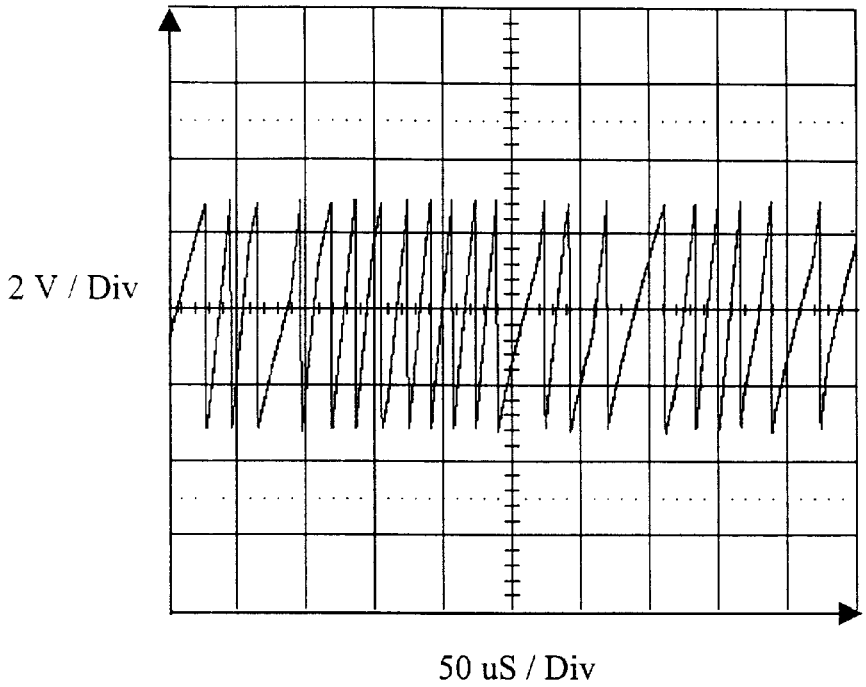
FIG. 5A shows a pseudo-randomly modulated saw tooth signal for PWM.
Figure 5B:
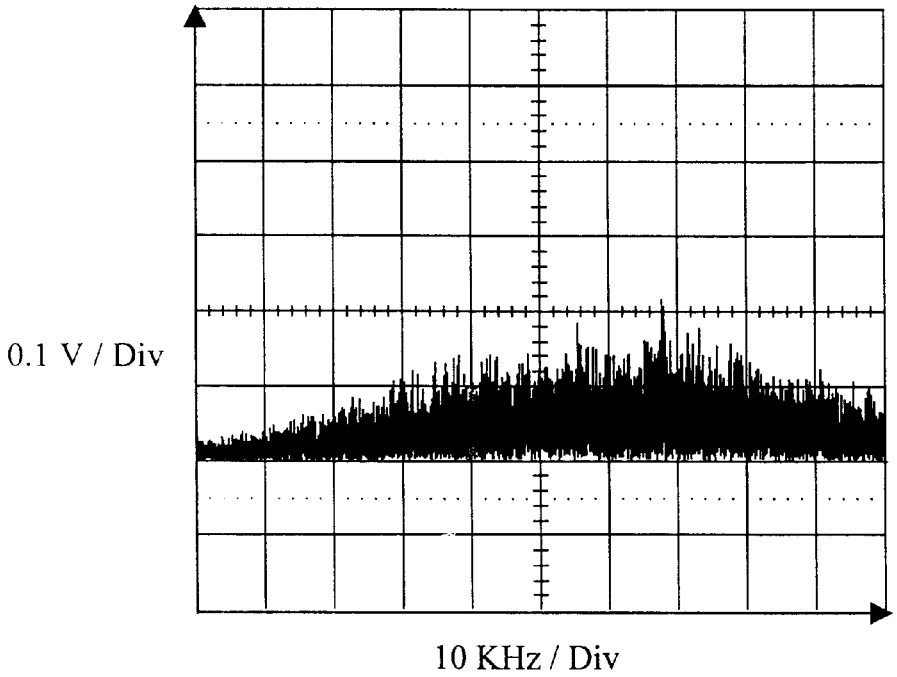
FIG. 5B shows a frequency spectrum for the pseudo-randomly modulated saw tooth signal of FIG. 5A.

The sawtooth signal output of the VCO 6, as used in the first embodiment of the invention of FIG. 1 is shown in FIGS. 5A and 5B. FIG. 5A shows the pseudo-randomly modulated sawtooth signal for PWM. FIG. 5B shows the frequency spectrum of the pseudo-randomly modulated sawtooth signal for PWM. As shown in FIG. 5A, the pseudo-randomly modulated sawtooth signal has variable, pseudo-random length sawtooth pulses. As shown in FIG. 5B, the frequency distribution of the pseudo-randomly modulated sawtooth signal appears to be substantially random, with a center frequency and tailing off in either direction therefrom along the frequency axis.

In developing the feedback shift register as a pseudo-random noise generator, further modifications are possible when the characteristics of the system are considered. A digital pseudo-random signal generator displays a few interesting characteristics. Firstly, in one full cycle, $T_{shift}$ or $2^m$ clock cycles, the number of "0" bits output is one greater than the number of "1" bits output. The extra "0" bit in the number of "0" bits is due to the "stuck" state, which is excluded from the used states.

Furthermore, in one full cycle of an m-bit digital pseudo-random signal generator using an XNOR gate for feedback, half of the runs of consecutive "0" bits have a run length of 1 bit. A quarter of the runs of consecutive "0" bits have a run length of 2 bits. One eighth of the runs have a run length of 3 bits. This pattern continues, up to $1/2^m$ of the runs having a run length of m bits.

Lastly, when one full cycle, $T_{shift}$, of "1" bits and "0" bits is compared bit-by-bit with the same sequence shifted by n bits, the number of differences (disagreements) between the original cycle and the shifted cycle will be one greater than the number of similarities (agreements).

The pattern of run lengths above (e.g., up to $1/2^m$ of the runs have a run length of m bits) is particularly important for considerations of a modified feedback shift register, as in the second and third variations discussed below. If one considers the output from t=0 to t=infinity, the output signal is not random. Conversely, if one considers the output within $T_{shift}$, and $T_{shift}$ is significantly or sufficiently long, the output appears random, but is actually in an orderly manner. Although the pseudo-randomness seems contradictory, it is advantageous for the creation of a digital modulation scheme that is free from acoustic resonance.

A four-bit feedback shift register with XOR (instead of XNOR) is used hereinafter as an example to show the principle applied in the first and third variations of the pseudo-random noise generator of the embodiments of invention. It should be noted that using XOR or XNOR for feedback does not affect randomness since $T_{shift}$ is sufficiently long. In a four-bit feedback shift register starting with, for example, four bit outputs (e.g., flip-flops) of Qa=1, Qb=1, Qc=1 and Qd=1, the signal from the last bit output, Qd, will be 1 1 1 1 0 0 0 1 0 0 1 1 0 1 0—1 1 1 1 0 0 0 1 0 0 1 1 0 1 0— etc. If the Qd output is considered as a voltage signal for controlling an oscillator frequency, the initial four consecutive "1" bits will set the oscillator frequency high, and the oscillator frequency will stay high for several cycles. The following three consecutive "0" bits will set the oscillator frequency low, and the oscillator frequency will stay low for several cycles.

If the lamp LMP acoustic resonant frequency is exactly the same as either one of the high or low frequencies, the arc of the LMP is prone to instability. In practical applications, the lower frequency (consecutive "0" bits) is more prone to acoustic resonance than the higher frequency (consecutive "1" bits"), because the magnitude of the ripple is higher at lower frequency than at higher frequency.

The digital output of the feedback shift register may be used directly as in the first variation of the pseudo-random noise generator. However, the stagnation of frequency (e.g., as caused by long run lengths) may be avoided by further variations of the pseudo-random noise generator.

In a second variation of the pseudo-random noise generator incorporated in the embodiments of the invention, an analog filter network (an RC analog low pass filter) filters the digital signal, so that the pseudo-random signal is more like an exponential ramp than a rectangular wave, ameliorating the frequency stagnation. The advantage of analog filtering is the simplicity of the circuit. The disadvantage is that external components are required, that can not be integrated into the digital pseudo-random noise generator. In FIG. 3, the capacitor C3, resistor R1, and resistor R2 in combination form an analog filter network 9 filters the digital signal. The RC analog low pass filter has a time constant equal to or greater than the clock period $f_{clock}$ of the feedback shift register, and as shown in FIG. 3, is coupled between the output Q of flip-flop D16 of the feedback shift register and the input of the voltage controlled PWM ramp generator (VCO 6) to further modulate the PWM ramp. It should be noted that although the RC analog low pass filter is shown in FIG. 3, the first variation may omit the analog filter network for filtering the digital signal, although in such a case, the resistor R2 is preferably retained for setting the frequency band.

Figure 6:
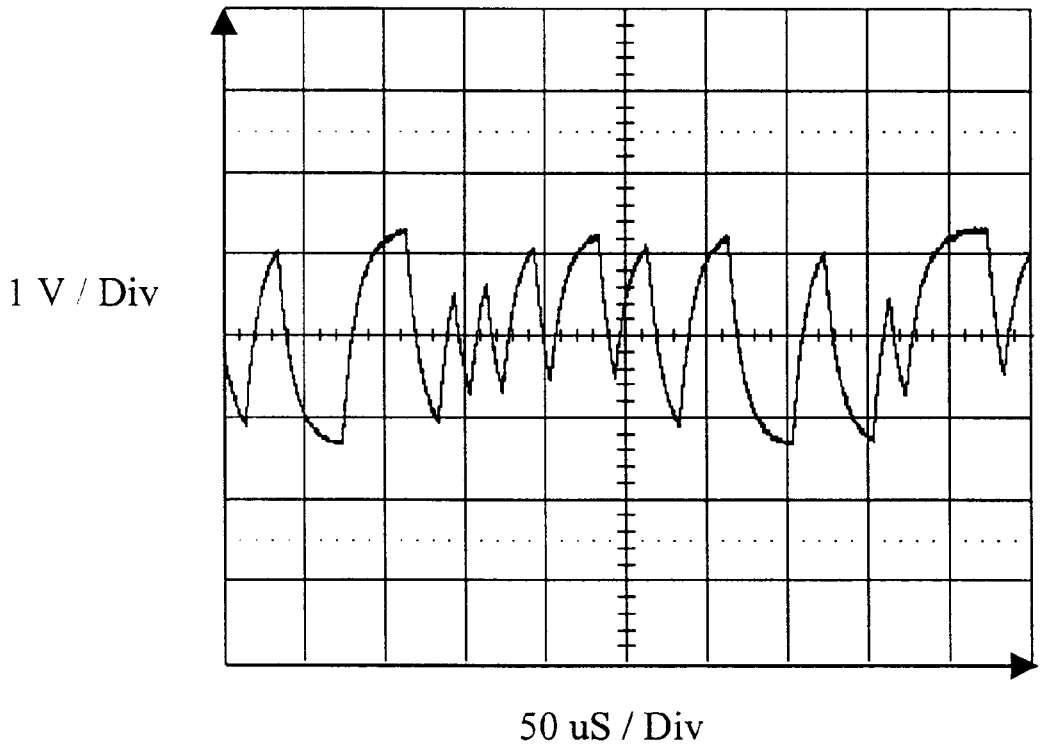
FIG. 6 shows a digital output of the basic pseudo-random noise generator when filtered by an RC filter, as a second variation of the pseudo-random noise generator.

FIG. 6 shows a filtered pseudo-random output generated by the second variation of a pseudo-random noise generator, also scaled down from ±5 V. This 16-bit filtered pseudo-random signal may alternatively be used as the input of the voltage controlled oscillator (VCO) of the first and second embodiments of FIGS. 1 and 2.

A third variation of a pseudo-random noise generator takes advantage of special characteristics of the feedback shift register by reducing the maximum run length of consecutive "0" bits, although the invention also is inclusive of implementations reducing the run-length of "1" bits or both the "0" and "1" bits.

In a third variation of the pseudo-random noise generator according to the embodiments of the present invention, a digital method is used to break the run length of the consecutive runs so that the maximum number of low or high-frequency cycles is reduced. That is, the feedback shift register has its output sequence interrupted using extra logic circuitry to modulate the number of consecutive runs in a state. As applied to the example four-bit shift register, the four consecutive "1" bits or the three consecutive "0" bits are broken up to create a modified feedback shift register.

Figure 7:
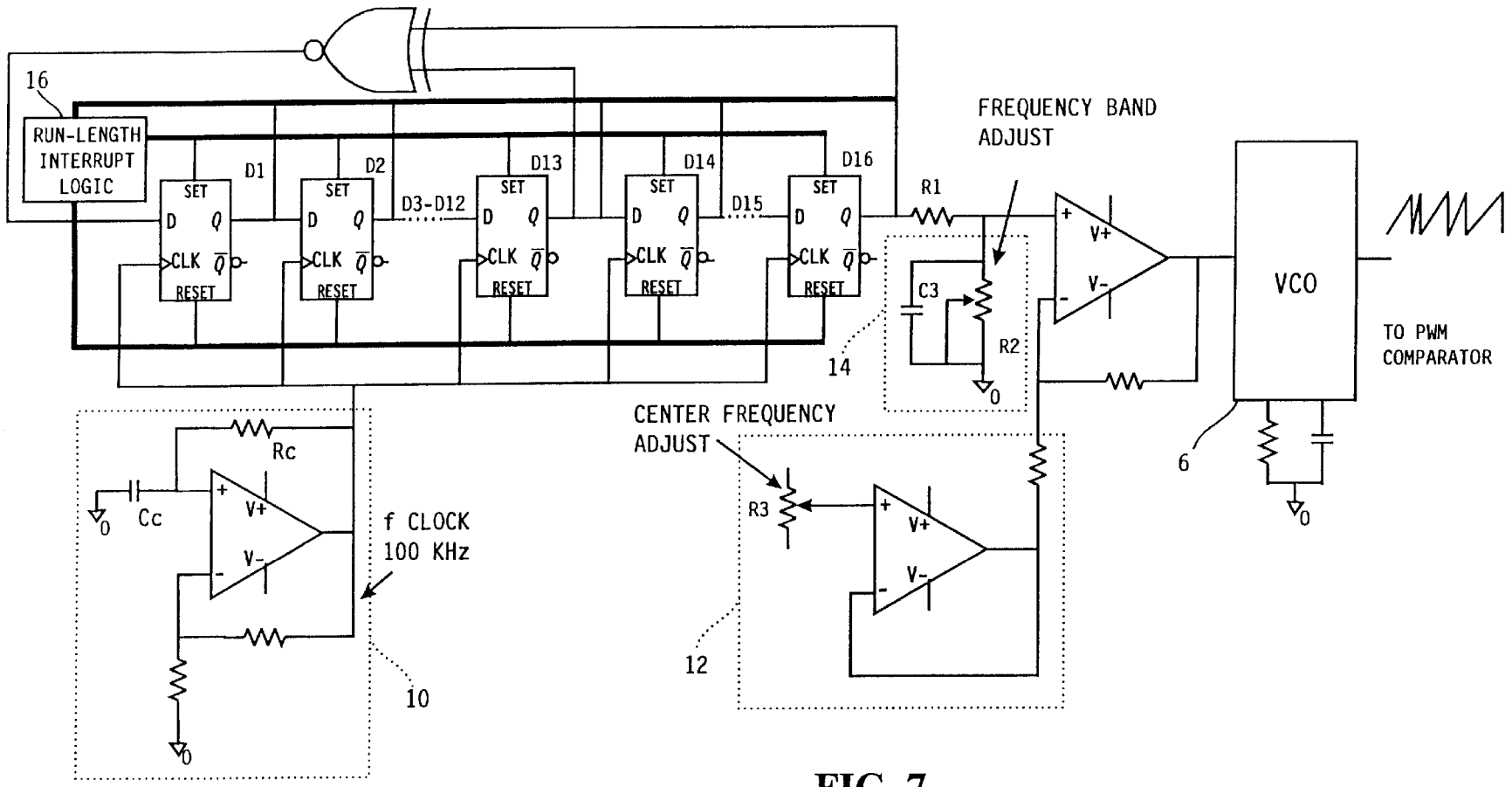
FIG. 7 shows a schematic of a third variation of a 16-bit pseudo-random noise generator and related circuit to control the PWM pulse width modulation) frequency.

FIG. 7 shows an example of the third variation of a pseudo-random noise generator, applied to a 16-bit pseudo-random noise generator. The elements of FIG. 7 substantially correspond to those of FIG. 3. However, each of the SETs and RESETs of the flip-flops D1–D16 is individually connected via bus lines to a run-length interrupt logic circuit 16. The bus lines are indicated by thicker lines in FIG. 7. The run-length interrupt logic circuit 16 monitors each of the outputs Q of the flip-flops D1–D16, and is configured to recognize certain states. When a certain state is detected, the run-length interrupt logic circuit 16 SETs and RESETs each of the flip-flops to a state having a reduced run length. The reduced run length state may be reached by skipping one or more states in the sequence to one that has a shorter run length.

Figure 8:
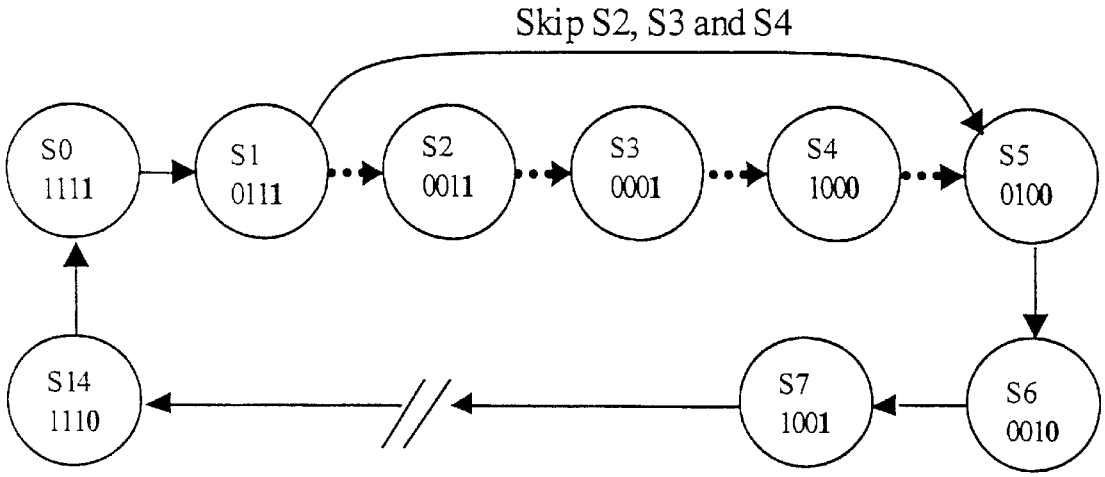
FIG. 8 shows the state diagrams of both a 4-bit basic and a 4-bit modified pseudo-random noise generator.

As discussed above, a four-bit feedback shift register may be used as an example to show the principle applied in the third variations of the pseudo-random noise generator of the embodiments of the invention, in this case, the state-skipping principle. FIG. 8 shows an example of the third variation of a pseudo-random noise generator, applied to a four-bit pseudo-random noise generator. That is, FIG. 8 shows a state diagram of the first variation 4-bit pseudo-random noise generator using dotted arrows, and a state diagram of the third variation 4-bit pseudo-random noise generator using solid arrows. Qd, as discussed above, is represented in the state diagram of FIG. 8 by the rightmost bit of each 4-bit number shown in each state. As shown in FIG. 8, by skipping three states (S2–S4), the total number of states is reduced from 15 in the first variation generator to 12 in the modified generator of the third variation. That is, those states that constitute the end of the long run length (4 bits) of "1" bits and/or the beginning of the long run length (3 bits) of "0" bits, e.g., states S2, S3, and S4, are skipped. The maximum duration that Qd remains in the "1" bit state is reduced from 4 clock cycles to only 2 clock cycles. The maximum duration that Qd remains in the "0" bit state is reduced from 3 clock cycles to only 2 clock cycles.

Figure 9A:
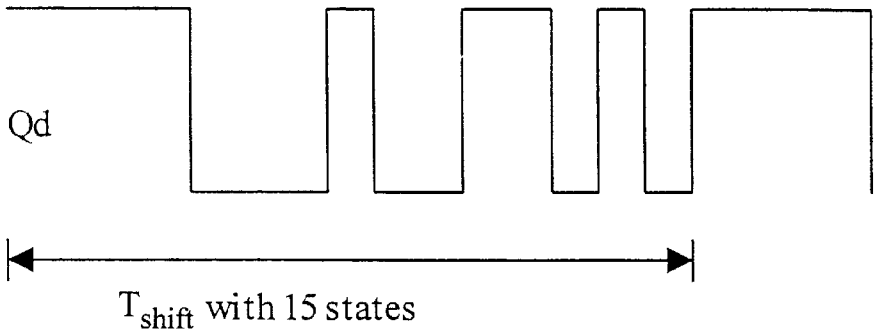
FIG. 9A shows the digital output of a basic 4-bit pseudo-random noise generator.
Figure 9B:
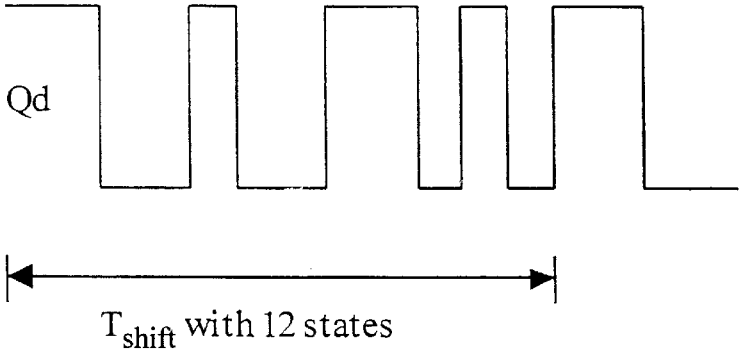
FIG. 9B shows the digital output of a modified 4-bit pseudo-random noise generator.

FIG. 9A shows a timing diagram of the digital output of the basic 4-bit pseudo-random noise generator with XOR (feedback shift register), e.g., corresponding to the first variation of the pseudo-random noise generator used in the embodiments of the invention. FIG. 9B shows a timing diagram of the digital output of the modified pseudo-random noise generator with XOR (4-bit modified feedback shift register) according to the third variation.

As is known, arc instability caused by acoustic resonance is directly related to (i) the operating frequency, (ii) the magnitude of the excitation current at the acoustic resonant frequency, and (iii) the duration of the operating frequency at which the acoustic resonance is excited. For example, if there were only one cycle of operating frequency with significant magnitude, and being exactly the same as the acoustic resonant frequency of the lamp, the arc would probably be stable. The reduction in the duration of the operating frequency as applied by the third variation of the pseudo-random noise generator used in the embodiments of the present invention decreases the number of cycles of the saw tooth frequency stagnating at one particular frequency. Hence, the excitation energy is reduced and acoustic resonance is avoided at that frequency. An advantage is that the digital logic circuit that creates the state sequence modification can all be integrated into the basic feedback shift register.

In the implementation shown in FIG. 7, a 16-bit XNOR feedback shift register, using D-type flip-flops uses the run-length interrupt logic 16 to generate sufficient randomness within the period $T_{shift}$. As shown in FIG. 7, the XNOR gate has inputs tapped from the output Q of the 16th-bit flip-flop D16 and the output Q of the 13th-bit flip-flop D13, and an output connected to the input D of the 1st-bit flip-flop D1. The XNOR gate sets the 'stuck' state as all "1" bits, since all the D-type flip-flops D1–D16 initialize themselves to 0-state. The $f_{clock}$ is set at 100 KHz frequency, i.e., 10 $\mu$s per cycle. The total number of states for a 16-bit shift register is 65536. However, the actual usable states for a feedback shift register is 65535, because of the one 'stuck' state. Accordingly, the period of $T_{shift}$ is 65535*10 $\mu$s=655 ms.

Absent the modification of the run-length interrupt logic 16, in one period of $T_{shift}$ there are 32768 "0" bits and 32767 "1" bits. Accordingly, absent the run-length interrupt logic 16, there is one 0-state of 16 clock cycles in length (160 $\mu$s); two 0-states of 15 clock cycles in length (both of which are part of the 16 clock cycle length 0-state); four 0-states of 14 clock cycles in length, three being part of the 16 clock cycle length 0-state and one being a 14 clock cycle length 0-state, and so on as noted for the pattern of up to $1/2^m$ of the runs having a run length of m bits.

However, according to the third variation of the pseudo-random noise generator used in the embodiments of the invention, the run-length interrupt logic 16 of the modified feedback shift register breaks the longer run lengths, and more particularly, breaks the longer run lengths of the 0-state runs. For example, if the 16 clock cycle length 0-state (160 $\mu$s) is broken, the maximum run length for the 0-state will be that of the 14 clock cycle length 0-state (140 $\mu$s). Further, if the 14 clock cycle length 0-state (140 $\mu$s) is also broken, the maximum run length for the 0-state will be that of the 13 clock cycle length 0-state (130 $\mu$s).

Increasing the number of bits of the feedback shift register increases the apparent randomness of the output. However, a significant drawback of increasing the number of bits is the increased length of consecutive runs in the same state, which cause frequency stagnation and increase the possibility of acoustic resonance. So, to increase the randomness while avoiding frequency stagnation, it is necessary to increase not only the number of bits but also the clock frequency, $f_{clock}$. An experiment conducted by the inventors, however, showed no improvement on arc stability by increasing from a 16-bit register to a 24-bit register and increasing $f_{clock}$ from 100 KHz to 125 KHz.

Figure 10:
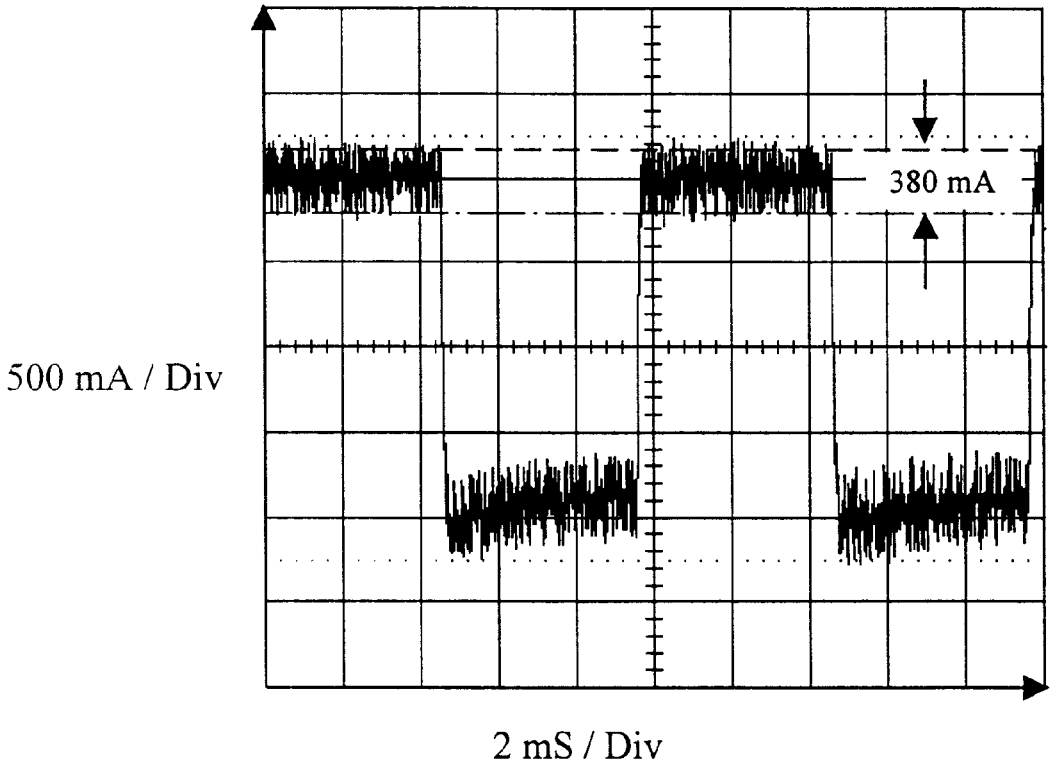
FIG. 10 shows a rectangular lamp current, in time domain, of an embodiment of the present invention in normal operation with pseudo-random noise modulated high frequency ripple.

In order to test the principle of the invention in a worst case scenario, the arc stability of various 100 W metal halide lamps was tested, with L1 of less than 5 mH in a half bridge configuration (as in FIG. 1), using pseudo-random noise with analog filtering as in the second variation. FIG. 10 shows a rectangular lamp current, in time domain, in normal operation with pseudo-random noise modulated high frequency ripple, for a 100 W MHL (metal halide lamp) for the circuit of FIG. 1. Output power is approximately 100 W, and lamp current is approximately 960 mA. As shown in FIG. 10, the peak to peak high frequency ripple in the time domain over an entire band was measured at approximately 380 mA. Within the entire band, in the center band of about 60 KHz, the peak to peak ripple was measured at about 21 mA. Accordingly, the ratio of ripple to RMS current for the entire frequency band is approximately 39%, while the ratio of ripple to RMS current for the center frequency of 60 KHz is approximately 22%. In both cases, the ripple ratio is significantly larger than the industry's consensus of 10% or less for a suitable ripple ratio to avoid instability. Nevertheless, the lamp arc of 100 W metal halide lamps from various manufacturers was stable without regard to the selection of the switching frequency band.

Accordingly, the present invention overcomes the difficulties in reducing ripple for arc stability, requiring neither high value inductance nor high value capacitance in the LC low-pass output filter network, yet the arc is stable throughout the frequency band of interest, e.g., that for operating the power inverter. The implementation is to digitally generate pseudo-random voltage as a controlling source to control the switching frequency of the power inverter. The digital pseudo-random voltage can be a basic feedback shift register, or a modified feedback shift register (reducing maximum run-length). Either shift register can be filtered with an analog filter. Accordingly, the frequency of the higher frequency ripple produced by an inverter and superimposed on the lower frequency-driving source is modulated by a pseudo-random signal. Arc instability due to acoustic resonance is eliminated. The use of pseudo-random source modulation significantly lessens the requirements for high frequency ripple attenuation and eliminates the acoustic resonance associated with high intensity discharge lamps. The cost of the ballast is thus reduced.

Although the above description sets forth particular embodiments of the present invention, modifications of the invention will be readily apparent to those skilled in the art, and it is intended that the scope of the invention be determined solely by the appended claims.

What is claimed is:

1. A method of driving a high intensity discharge lamp, comprising:

delivering power to the high intensity discharge lamp during normal operation after starting using a lower frequency rectangular wave current;

modulating a frequency of a higher frequency ripple using a pseudo-random signal, said pseudo-random modulation preventing arc instability due to acoustic resonance; and superimposing the pseudo-randomly modulated higher frequency ripple on the lower frequency rectangular wave current delivered to the high intensity discharge lamp.

2. The method of claim 1, further comprising:

igniting the high intensity discharge lamp with an ignition voltage, the ignition voltage being biased by a lower frequency rectangular voltage.

3. The method of claim 2, wherein the ignition voltage has a frequency no less than approximately 16 KHz, said ignition voltage generated by a resonant circuit.

4. The method of claim 3, wherein the ignition voltage has a frequency no less than approximately 20 KHz.

5. The method of claim 1, wherein the frequency of said lower frequency rectangular current is no greater than approximately 1 KHz.

6. The method of claim 1, further comprising:

generating by a half bridge inverter both the higher frequency ripples and the lower frequency rectangular current; and regulating by said half bridge inverter lamp power and lamp output.

7. The method of claim 1, further comprising:

generating by a full bridge inverter both the higher frequency ripples and the lower frequency rectangular current; and regulating by said fall bridge inverter lamp power and lamp output.

8. The method of claim 1, further comprising:

generating said pseudo-random signal with a feedback shift register.

9. The method of claim 8, further comprising:

interrupting an output sequence of said feedback shift register; and modulating a number of consecutive runs in states of said feedback shift register.

10. The method of claim 9, said modulating comprising:

reducing a length of a longest ran length among said states of said feedback shift register.

11. The method of claim 8, further comprising filtering a digital output of said feedback shift register by a low pass RC filter to modulate the higher frequency ripples.

12. A discharge lamp driving circuit for driving a high intensity discharge lamp, said circuit comprising:

DC voltage input connections for powering the discharge lamp driving circuit;

lamp-driving connections between which the high intensity discharge lamp is connectable;

bridge circuitry connected to the DC voltage input connections, said bridge circuit including high/low frequency driver control circuitry connected to drive switching elements of the bridge circuitry, said high/low frequency driver control circuitry igniting the lamp connected between said lamp driving connections by a higher frequency voltage, biased by a lower frequency rectangular voltage during starting;

an LC tank circuit connected to the lamp driving connections and to the switching elements of the bridge circuitry;

a voltage controlled pulse width modulation (PWM) ramp generator connected to the high/low frequency driver control circuitry to modulate the switching duty cycle of the switching elements using a PWM signal; and a digital pseudo-random noise generator connected to the voltage controlled PWM ramp generator to modulate the frequency of the PWM signal by pseudo-random noise.

13. The driving circuit of claim 12, wherein the ignition voltage has a frequency no less than approximately 16 KHz, said ignition voltage generated by said LC tank circuit.

14. The driving circuit of claim 12, wherein the ignition voltage has a frequency no less than approximately 20 KHz.

15. The driving circuit of claim 12, wherein the frequency of said lower frequency rectangular current is no greater than approximately 1 KHz.

16. The driving circuit of claim 12, wherein said digital pseudo-random noise generator comprises a feedback shift register having at least a 4-bit length.

17. The driving circuit of claim 16, wherein said digital pseudo-random noise generator comprises a feedback shift register having at least a 16-bit length.

18. The driving circuit of claim 16, further comprising:

an RC low pass filter having a time constant substantially no less than a clock period of the feedback shift register, coupled between an output of the feedback shift register and an input of the voltage controlled PWM ramp generator, to further modulate the PWM ramp.

19. The driving circuit of claim 12, further comprising:

a frequency band adjusting circuit connected between the pseudo-random noise generator and the bridge circuit for adjusting the frequency band of higher frequency ripple.

20. The driving circuit of claim 12, further comprising:

a center frequency adjusting circuit connected between the pseudo-random noise generator and the bridge circuit for adjusting the center frequency of the higher frequency ripple.

21. The discharge lamp driving circuit according to claim 12, wherein the switching elements are in half bridge configuration.

22. The discharge lamp driving circuit according to claim 12, wherein the switching elements are in full bridge configuration.

23. The driving circuit of claim 12, wherein said digital pseudo-random noise generator comprises a feedback shift register having at least a 4-bit length; and said feedback shift register comprises a run-length interrupt logic circuit that modulates a number of consecutive runs in states of said feedback shift register.

24. The driving circuit of claim 12, wherein said run-length interrupt logic circuit reduces a length of a longest run length among said states of said feedback shift register.

* * * * *

UNITED STATES PATENT AND TRADEMARK OFFICE

CERTIFICATE OF CORRECTION

PATENT NO. : 6,144,172
DATED : November 7, 2000
INVENTOR(S) : Y. Sun

It is certified that error appears in the above-identified patent and that said Letters Patent is hereby corrected as shown below:

Column 14,
Line 27, "fall" should be -- full --.
Line 38, "ran" should be -- run --.

Signed and Sealed this

First Day of January, 2002

*Attest:*

*Attesting Officer*

JAMES E. ROGAN
*Director of the United States Patent and Trademark Office*